US005143306A

United States Patent [19]

Nilsson

[11] Patent Number: 5,143,306

[45] Date of Patent: Sep. 1, 1992

[54] WASTE DISINTEGRATING DEVICE FOR A DISHWASHER

[75] Inventor: Nils S. Nilsson, Ödeshög, Sweden

[73] Assignee: Aktiebolaget Electrolux, Stockholm, Sweden

[21] Appl. No.: 687,987

[22] Filed: Apr. 19, 1991

[30] Foreign Application Priority Data

Apr. 26, 1990 [SE] Sweden ..... 9001501

[51] Int. Cl.[5] ..... B02C 23/00

[52] U.S. Cl. ..... 241/46.012

[58] Field of Search ..... 241/46 R

[56] References Cited

U.S. PATENT DOCUMENTS 2,843,328 7/1958 Stoynoich .
3,680,829 8/1972 McCoy .
3,981,456 9/1976 Hahn et al. ..... 241/46 R
4,201,345 5/1980 Ziegler ..... 241/46 R
4,228,962 10/1980 Dingler et al. .
4,350,306 9/1982 Dingler et al. .
4,448,359 5/1984 Meyers ..... 241/46.06
4,621,947 9/1986 Duncan ..... 241/46 R X
4,795,102 1/1989 Jordan et al. ..... 241/100.5 X

*Primary Examiner*—Mark Rosenbaum
*Assistant Examiner*—Frances Chin
*Attorney, Agent, or Firm*—Pearne, Gordon, McCoy & Granger

[57] ABSTRACT

A device for a dishwasher includes a tub (10) in which liquid, by means of a circulation pump (17) and at least one rotating wash arm (11), is sprayed onto the dishes. The liquid is collected at the bottom (13) of the tub and discharged by a drain pump (21). The bottom (13) is provided with a coarse grating (42) for collecting food waste dislodged from the dishes. The device comprises a rotating and cutting means (44) cooperating with the grating (42) for disintegrating the waste on the grating so that the disintegrated waste falls down into a container (43) which is in communication with the inlet of the drain pump (21).

11 Claims, 2 Drawing Sheets

WASTE DISINTEGRATING DEVICE FOR A DISHWASHER

BACKGROUND OF THE INVENTION

This invention relates to a device for a dishwasher comprising a tub in which liquid, preferably water, by means of a circulation pump and at least one rotating wash arm, is sprayed onto the dishes and then collected at the bottom of the tub for recirculation. At the end of such a washing cycle, the spent water is discharged by means of a drain pump, the tub bottom being provided with means for collecting food waste from the dishes.

It is known in the art to provide the tub bottom with at least one sieve covering a sump in which water is collected before it is recirculated through the wash arm in the tub, as noted above. After each wash cycle, the water is emptied from the sump by means of the drain pump. Normally, the sieve slopes so that food waste dislodged from the dishes is carried towards a basket-shaped portion of the sieve which can be removed and which is comparatively easily accessible for cleaning. The cleaning, however, has to be done manually, and sometimes under flowing water.

In order to reduce the need for manual cleaning, it has previously been suggested to disintegrate or grind up the waste by passing it through rotating cutting elements which are connected to the circulation pump in the circulation system of the dishwasher, or are connected to the drain pump. Large bone chips and other hard objects are trapped by a coarse sieve in front of the cutting elements.

When using these devices, there is still a risk, however, that hard objects will bypass the coarse sieve and jam the cutting elements, and hence also jam the associated pump, because the cutting elements are usually integrated with the pump impeller or its drive. To remove such an object is both troublesome and time-consuming because substantial disassembly of the machine is required to gain access to the cutting elements.

It is also known in the art to clean the collecting part of the sieve by directing a stream of water onto it from one of the wash arms, thereby disintegrating the material, which is then discharged together with the water. However, this method has several drawbacks. It can only be used on fragile or easily divisible material wherein water action alone can cause sufficient disintegration. The water action is generally limited to a very small annular surface which constitutes only a small fraction of the total surface of the basket-shaped collecting container. Another disadvantage is that the arrangement consumes an excessive amount of energy by recirculating a much larger quantity of water than is required for cleaning the dishes. A further drawback is that the arrangement demands that the liquid level in the sump be maintained at an exact level which is above the inlet opening of the circulation pump but below the filter surface. Consequently, if the spray nozzles of the wash arm become clogged, there is a risk that the water level in the sump will rise sufficiently to cause the water jet coming from the wash arm to impact against the water surface instead of the food waste.

SUMMARY OF THE INVENTION

The purpose of this invention is to create a device which, by means separate from the pump function, will effectively disintegrate the food waste, with the larger particles of the disintegrated waste being collected and stored at the inlet side of the drain during the dishwashing procedure, and then discharged together with the water near the conclusion of the dishwashing procedure. The construction has the advantages of being easily accessible and simple to disassemble. A further advantage is that the arrangement makes it possible to mechanically clean a filter area which is a part of the separating system of a dishwasher.

DETAILED DESCRIPTION OF THE INVENTION

Figure 1:
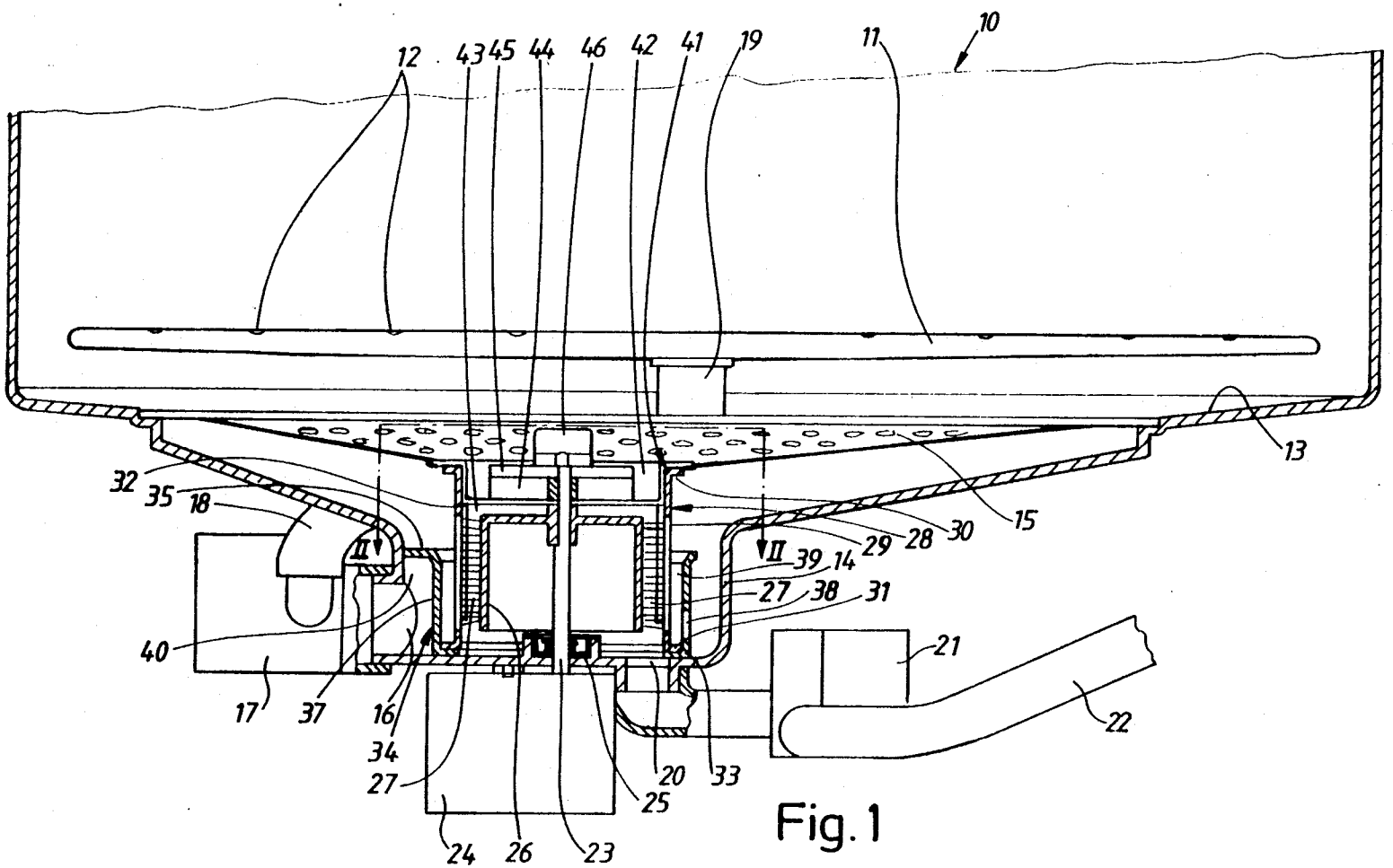
FIG. 1 is a vertical cross section through a lower part of a dishwasher provided with a device according to the invention.
Figure 2:
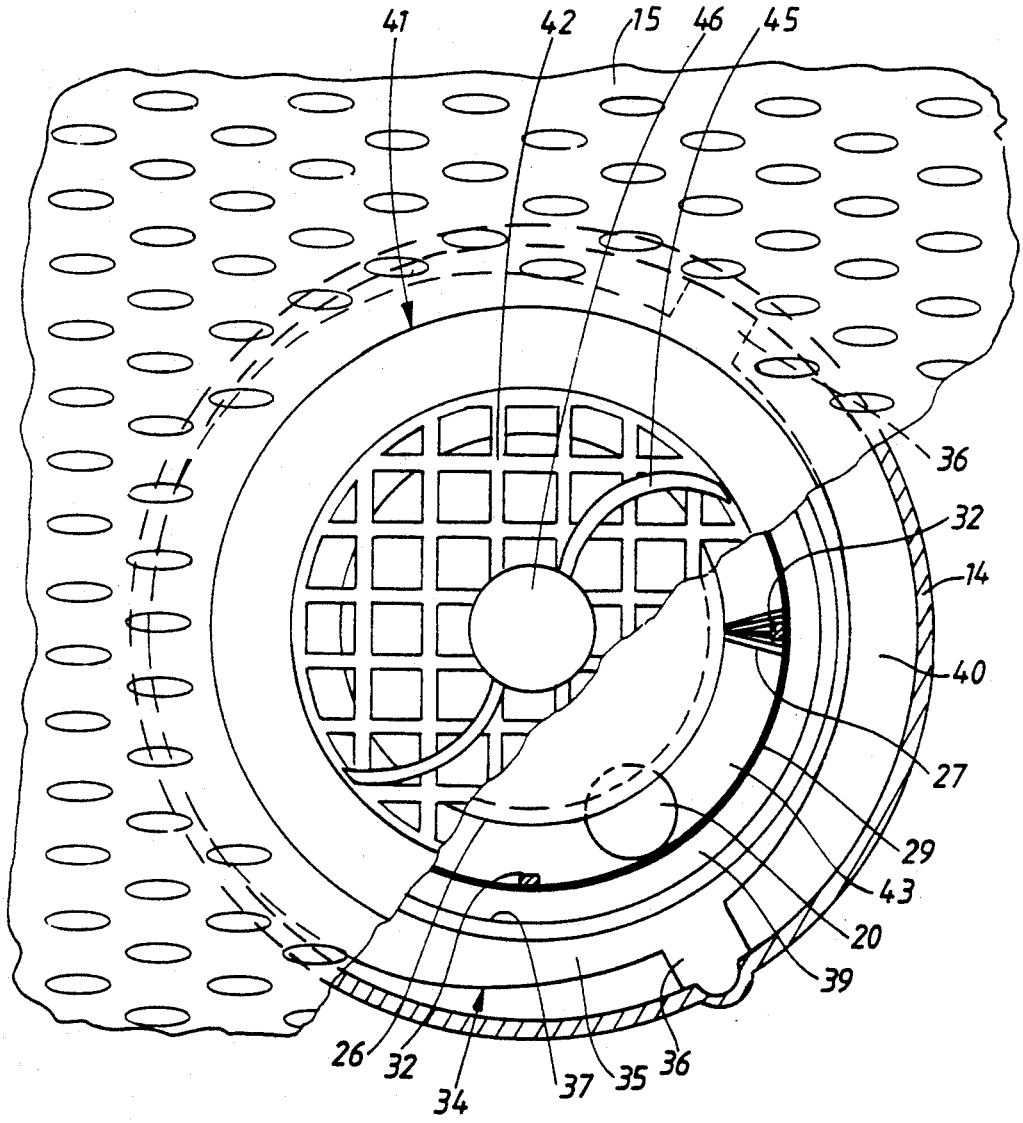
FIG. 2 is a fragmentary, cross-sectional view of the device, with the plane of the section being indicated by line II—II in FIG. 1, and with portions broken away for clarity.

Referring to the drawings, a dishwasher tub 10 in which dishes are stored in a basket has at least one rotating wash arm 11 from which liquid, preferably water, is sprayed through nozzles 12 onto the dishes. The bottom 13 of the tub slopes towards a sump 14 and is covered by a hopper-like fine sieve 15. The sump 14, at the lower part of its side wall, is provided with an outlet opening 16 which communicates with a circulation pump 17. The outlet of the circulating pump is connected to a pipe 19 via hose 18. The pipe 19 is arranged centrally in the tub and supports the wash arm 11 for rotating motion. At the bottom of the sump, another outlet opening 20 is connected to a drain pump 21 through which the water in the dishwasher is discharged via a hose 22.

Within the sump, there is a vertical shaft 23 which is driven by a motor 24 that is fixed below the bottom of the sump. The shaft is sealed from the sump by means of a seal 25. The shaft 23 supports a cylindrical brush holder 26 which, at two locations situated opposite to each other, is provided with bristle elements 27 which follow the rotation of the shaft. The tips of the bristle elements are in contact with a sleeve 28 whose envelope surface 29 consists of a fine sieve, such as a wire mesh, which is clamped between an upper ring 30 and a lower ring 31. Between the rings 30 and 31, and spaced at equal distances around the periphery, are several ribs 32 which serve as brush cleaning elements.

The lower ring 31 of the sleeve 28 rests on a lower inwardly directed flange 33 of a water guide 34 resting on the bottom of the sump. The water guide 34 also has an outwardly directed, oval-shaped flange 35 which abuts the side wall of the sump near the inlet of the circulation pump but is spaced a distance from the wall at the opposite side and is secured to it by two coplanar lateral projections 36. The water guide has a cylindrical wall 37 which, at its lower part, has an opening 38 through which water can flow freely between two annular shaped spaces 39 and 40, respectively defined by the sleeve 28 and the water guide 34, and the water guide 34 and the wall of the sump 14.

The upper ring 30 of the sleeve supports a cup-shaped, hatlike member 41 having a central coarse grating 42 which forms a container 43. The container is covered by the grating 42, and is surrounded by the envelope surface 29 and the bottom of the sump 14.

Above the grating 42 and fastened to the shaft 23 are knives 44. The knives are curved and cooperate with the grating to disintegrate objects which fall onto the grating. The knives 44 are fastened on a knife supporting arm 45 that is fixed to the shaft 23 by means of a nut 46, which is removably fastened to the shaft 23 so that the knives can be removed for disassembly of the device.

The device operates in the following manner. Food waste dislodged from the dishes falls to the bottom of the tub and is transported by flowing water to the grating 42. At a certain predetermined time, the motor 24 is started, causing the shaft 23 and the knives 44 to rotate. The waste on the grating will then be disintegrated and transported down into the container 43. All of the larger particles, during the circulation of the water, will remain in the container until the drain pump 21 is started, whereupon the larger particles are discharged with the water. As the knives 44 disintegrate, the waste inside of the envelope surface 29, at the same time, is being cleaned by the bristles 27 which are in contact with the fine sieve. Particles of food waste which adhere to the bristles 27 during the cleaning operation are knocked loose as the bristles move past and impinge upon the ribs 32. The particles of waste which are removed from the bristles fall to the bottom of the sump and are removed together with the water. The motor 24, which is driven at a comparatively low speed, is preferably operated for only a brief predetermined period of time during the dishwashing cycle.

While what is presently considered to be the most practical and preferred embodiment of the invention has been described, it is to be understood that the invention is not to be limited to the disclosed embodiment but, to the contrary, is intended to cover various modifications and equivalent arrangements included within the spirit and scope of the appended claims.

What is claimed is:

1. A device for a dishwasher comprising a tub (10) in which liquid by means of a circulation pump (17) and at least one rotating wash arm (11) is sprayed onto the dishes, collected at the bottom (13) of the tub and discharged by means of a drain pump (21), the bottom being provided with a collecting means (42) for waste dislodged from the dishes, the device further comprising a rotating and cutting means (44) driven independently of the circulation pump (17) and cooperating with the collecting means (42) for disintegrating the waste on the collecting means so that the disintegrated waste falls down into a container (43) which is in communication with the inlet of the drain pump (21).

2. A device according to claim 1, wherein the collecting device (42) comprises a grating which is placed above the container (43).

3. A device according to claim 1, wherein the cutting means (44) are activated temporarily at least once during the dishwashing procedure.

4. A device for a dishwasher comprising a tub (10) in which liquid by means of a circulation pump (17) and at least one rotating wash arm (11) is sprayed onto the dishes, collected at the bottom (13) of the tub and discharged by means of a drain pump (21), the bottom being provided with a collecting means (42) for waste dislodged from the dishes, the device further comprising a rotating and cutting means (44) driven independently of the drain pump (21) and cooperating with the collecting means (42) for disintegrating the waste on the collecting means so that the disintegrated waste falls down into a container (43) which is in communication with the inlet of the drain pump (21).

5. A device according to claim 1 or 4, wherein said cutting means (44) are driven by a slow-speed motor.

6. A device according to claim 1 or 4, wherein the container (43) is at least partly surrounded by a sieve.

7. A device according to claim 6, wherein the surface of the sieve (20) facing forward of the interior of the container (43) is contacted by a cleaning device (27).

8. A device according to claim 7, wherein the interior of the sieve (29) is provided with at least one rib for cleaning the cleaning device (27).

9. A device according to claim 7, wherein the sieve (29) has a cylindrical shape.

10. A device according to claim 7, wherein the cleaning device (27) is a brush.

11. A device according to claim 10, wherein the cleaning device (27) and the cutting means (44) are driven by the same shaft (23) from a motor (24) which is arranged under the bottom (13) of the tub.

* * * * *